United States Patent [19]

Laghi

[11] Patent Number: 5,072,649

[45] Date of Patent: Dec. 17, 1991

[54] DOUBLE ACTUATOR WITH BYPASS LINES FOR SYNCHRONIZED MOVEMENT

[76] Inventor: Aldo A. Laghi, 13 Meridian La., Ballston Lake, N.Y. 12019

[21] Appl. No.: 638,232

[22] Filed: Jan. 7, 1991

[51] Int. Cl.[5] ..... F01B 25/04; F15B 7/00

[52] U.S. Cl. ..... 91/171; 91/189 R; 60/546

[58] Field of Search ..... 60/546, 562; 91/170 R, 91/171, 178, 180, 189 R, 190

[56] References Cited

U.S. PATENT DOCUMENTS

| | | | |
|---|---|---|---|
| 3,152,503 | 10/1964 | Pearson | 91/171 X |
| 3,184,920 | 5/1965 | Lohbauer et al. | 60/546 |
| 3,387,757 | 6/1968 | Graffy et al. | 91/171 X |
| 3,636,817 | 1/1972 | Shapiro | 91/171 |
| 3,648,565 | 3/1972 | Probst et al. | 91/171 |
| 3,722,366 | 3/1973 | Richardson | 91/170 R |
| 3,805,530 | 4/1974 | Richardson | 91/171 X |
| 4,151,785 | 5/1979 | Koschek | 60/546 X |
| 4,192,222 | 3/1980 | Dits | 91/189 R X |
| 4,765,509 | 8/1988 | Eisenhut et al. | 91/171 X |

FOREIGN PATENT DOCUMENTS

| | | | |
|---|---|---|---|
| 54312 | 3/1948 | France | 91/171 |
| 1061927 | 5/1952 | France | 91/171 |

*Primary Examiner*—Edward K. Look
*Assistant Examiner*—John Ryznic
*Attorney, Agent, or Firm*—Joseph C. Mason, Jr.; Ronald E. Smith

[57] ABSTRACT

Hydraulic fluid under pressure is selectively supplied to multiple drive cylinders that are interconnected to one another and which have bypass lines allowing excess fluid to return to the source of hydraulic fluid as needed. Each drive cylinder receives a double acting piston and each piston is carried by and axially displaces a component pump shaft as it reciprocates within the drive cylinder under the influence of hydraulic pressure. A free end of each pump shaft carries a trip member that trips upper and lower limit switches when the piston reaches its top dead center and bottom dead center positions, respectively. The limit switches, when tripped, send electrical signals to a process computer that adjusts the system by opening and closing predetermined solenoid-operated mechanical valves to insure that each pump pumps a component at a predetermined ratio to the other pumps even if the pumps have differing capacities per pumping stroke and even if oil leaks around the piston seals or otherwise leaks from the system.

13 Claims, 1 Drawing Sheet

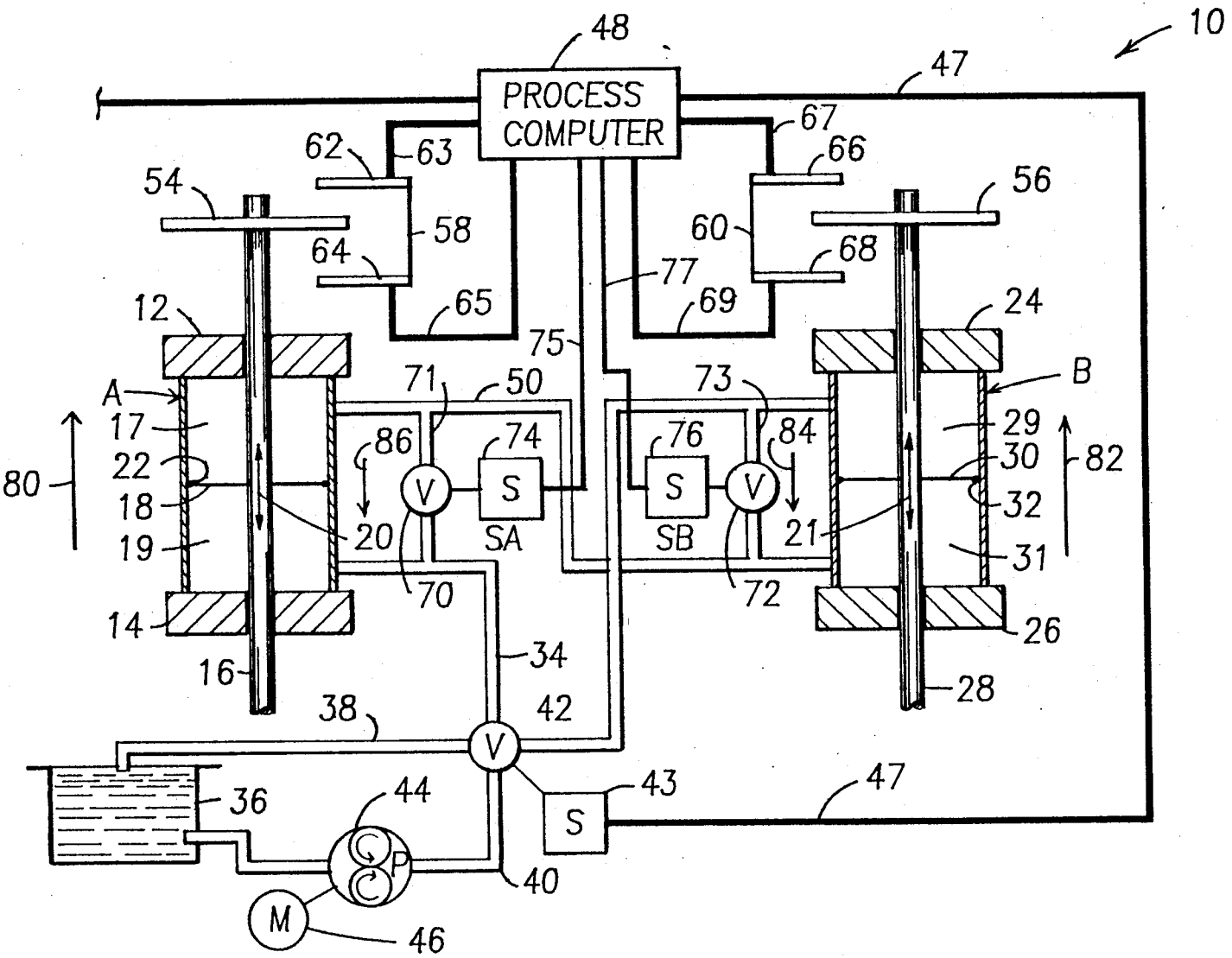
PROCESS COMPUTER
SA
SB
S
V
P
M

DOUBLE ACTUATOR WITH BYPASS LINES FOR SYNCHRONIZED MOVEMENT

TECHNICAL FIELD

This invention relates, generally, to metering machines. More particularly, it relates to a control means that insures that multiple components are pumped in a preselected fixed ratio to one another.

BACKGROUND ART

The art of injection molding includes devices that deliver differing silicone components to a mixer block where the components are mixed. The mixed components are then delivered to a molding machine.

Many of the known machines are pneumatically controlled; these machines often produce non-uniform parts because they suffer a loss of pressure when the pistons in the mixing and metering systems undergo a change in stroke direction. Even a momentary loss of pressure at the moment of stroke reversal can result in an inferior product.

Perhaps even more importantly, the machines known heretofore lack sophisticated metering means that insure that the components will always be mixed in their proper ratios. In an application where a component A is to be mixed with equal parts of a component B, the known machines work fine when all parts thereof are in perfect working order. However, if a leak develops anywhere in the system, the 1:1 ratio will be affected and the resulting product will not meet its design specifications. Even if no leaks appear in the system, other problems may crop up that result in an improper mixing of components. Moreover, the shot size may vary as well if the machine experiences any malfunction.

It has long been the conventional wisdom in the injection molding industry that the way to produce uniform, high quality product is to keep the machines in perfect working order. Thus, injection molding machines are frequently down for repairs, since even minor leaks or minor maladjustments result in unacceptable product.

Accordingly, inventors have turned their attention to the problem in predictable ways. Better, longer wearing seals have been developed to lengthen the time between maintenance procedures, for example. Monitoring devices that trigger alarms or machine shutdown when a leak has been detected have also been developed, and so on.

The art appears to be fully developed to those of ordinary skill, because about all that lies ahead appears to be still longer-wearing machine parts, better system monitors and detectors, and the like. It is indisputable that the art, taken as a whole in accordance with the requirements of law, neither teaches nor suggests how the art could be freed from the need for machines that operate substantially perfectly. If a machine could be developed that could produce uniform shot sizes and ideal component ratios even in the presence of leaking seals, imperfectly machined parts, and the like, such a machine would be truly revolutionary, completely unanticipated or suggested by the art, and entitled to the broadest protection afforded by the law.

DISCLOSURE OF INVENTION

Such a revolutionary machine will now be disclosed. It takes leaks, improperly machined parts, and other system irregularities, inadequacies or maladjustments in stride. It makes obsolete all earlier machines of its type.

This technological breakthrough is accomplished in part by providing hydraulic drive cylinders, of a certain construction, that are computer controlled.

More particularly, each drive cylinder is stationary (there are as many drive cylinders as there are components) and is concentrically mounted to the shaft of the pump it controls. A piston is centrally apertured and axially receives said shaft and is secured thereto; thus, the piston reciprocates conjointly with the shaft. A seal circumscribes the piston to seal its radially outermost edges to substantially prevent leakage of hydraulic fluid past the seal as the shaft and piston carried thereby reciprocate within the cylinder. However, unlike the case of prior art machines, leakage of fluid past the seal presents no problem.

Thus, it should be understood that each piston divides its associated cylinder into two chambers, each of which is filled with hydraulic fluid.

To facilitate this disclosure, the two chambers of each cylinder will be referred to as the upper and lower chambers although the novel system works in any orientation. A first conduit provides fluid communication between the upper chamber of a first cylinder, hereinafter referred to as cylinder A, and the lower chamber of a second cylinder, hereinafter referred to as cylinder B. Thus, as the piston of cylinder A drives fluid out of the upper chamber of said cylinder, said fluid flows to the lower chamber of cylinder B. There is no second line that interconnects the lower chamber of cylinder A and the upper chamber of cylinder B. Instead, a second line provides fluid communication between the lower chamber of cylinder A and a source of hydraulic fluid. A third line interconnects the top chamber of cylinder A and the same source of hydraulic fluid.

The upper and lower chambers of each cylinder are also in fluid communication with one another through a valved bypass line. Significantly, said valves are under the control of a process computer.

The free end of each pump shaft carries a radially extending trip member. When the shaft is in its uppermost position, i.e., when the upper chamber of a cylinder is substantially empty and the lower chamber thereof is substantially full, the trip member abuttingly engages a limit switch. The limit switch, when engaged, sends an electrical pulse to the process computer and the computer send signals to the system effective to begin downward travel of the pump shaft. When the shaft reaches its lowermost position, i.e., when the lower chamber is substantially empty, the trip member engages a lower limit switch which signals the computer to reconfigure the system to repeat the upward stroke of the pump shaft. The respective positions of the limit switches can be changed as needed to compensate for manufacturing tolerances of the pumps, i.e., if both pump shafts travel the same axial distance per reciprocation, but nonetheless deliver unequal quantities of components (to the barrel of a conventional molding machine), the position of the limit switches are adjustable to compensate for such differences in pump functioning. The position of the limit switches may also be adjusted if components A and B exhibit extreme differences in viscosity.

It should be understood from the outset that the hydraulic cylinders of the novel metering means drive conventional single or double-acting silicone pumps.

Selected valve members, to be described in detail hereinafter, are opened and closed as required by the computer to effect the various configurations of the novel system.

The novel configuration of parts enables the novel machine to work perfectly in situations that would require prior art machines to be shutdown and adjusted or repaired. Detailed examples of how the disclosed structure accomplishes this unprecedented feat will be set forth in the detailed description that follows.

It is therefore understood that the primary object of this invention is to revolutionize the art of injection molding machines.

However, since there are many other applications for the novel machine outside of the art of injection molding machines, it is also an important object of this invention to revolutionize the art of metering machines in general.

These and many other objects, advantages and features of the invention will become apparent as this description proceeds.

The invention accordingly comprises the features of constructions, combination of elements and arrangement of parts that will be exemplified in the construction set forth hereinafter and the scope of the invention will be set forth in the claims.

BRIEF DESCRIPTION OF THE DRAWINGS

For a fuller understanding of the nature and objects of the invention, reference should be made to the following detailed description, taken in connection with the accompanying drawings, in which:

The Fig. is a diagrammatic representation of the novel system.

BEST MODES FOR CARRYING OUT THE INVENTION

Referring now to FIG. 1, it will there be seen that an exemplary embodiment of the present invention is denoted as a whole by the reference numeral 10.

Machine 10, in a preferred embodiment, includes a hydraulic fluid-filled cylinder A and a hydraulic fluid-filled cylinder B. The use of gaseous fluids and other liquid fluids is within the scope of this invention. Cylinder A includes end plates 12 and 14 that are centrally apertured to axially receive pump shaft 16. Piston 18 which divides cylinder A into upper chamber 17 and lower chamber 19 is also centrally apertured and also axially receives said pump shaft 16. Cylinder A is stationary, however, whereas piston 18 is carried by shaft 16 and is reciprocable therewith as indicated by the directional arrow 20. Annular seal 22 circumscribes piston 18 and prevents leakage of fluid between chambers 17 and 19 when said seal is in substantially perfect operating condition.

Shaft 16 drives a positive displacement pump, not shown and not germane to the present invention, that pumps a first component to an unillustrated conventional mixer block. It should be understood that the novel metering means does not supply mixed components to a mold; it delivers components into the barrel (mixing block) of a conventional molding machine.

Cylinder B has end plates 24 and 26 that are centrally apertured to axially receive pump shaft 28. Piston 30, which divides cylinder B into upper chamber 29 and lower chamber 31, is also centrally apertured and also receives said pump shaft 28. Cylinder B is also stationary, and piston 30 is carried by shaft 28 and is accordingly reciprocable therewith as indicated by directional arrow 21. Annular seal 32 circumscribes piston 30 and prevents leakage of fluid between chambers 29 and 31 when said seal is in substantially perfect operating condition.

Chambers 17, 19 of cylinder A are filled with hydraulic fluid, as are chambers 29, 31 of cylinder B. Fluid is delivered to lower chamber 19 of cylinder A by branch supply conduit 34; that conduit is selectively connected to a source of hydraulic fluid 36 (lower left hand corner of the Fig.) through supply conduit 40 through a four way valve 42 which is under the control of solenoid 43. The oil in source 36 is pumped by hydraulic pump 44 that is driven by electric motor 46. Conduit 38 is a return line.

Solenoid 43 is under the control of a process computer 48 (upper center of the Fig.). Line 47 conductively couples said solenoid to said computer. As oil is delivered via conduit 34 to lower chamber 19 of cylinder A, piston 18 and hence pump shaft 16 are driven upwardly and oil is driven out of upper chamber 17 into lower chamber 31 of cylinder B via interconnecting conduit 50. This entry of oil into said lower chamber 31 drives piston 30 of cylinder B and hence pump shaft 28 upwardly. The oil in upper chamber 29 flows back to source 36 through branch supply conduit 52 and return conduit 38.

In this manner, pump shafts 16 and 28 travel upwardly in substantial unison. Theoretically, said shafts travel the same amount and cause pumping of exactly equal amounts of component. As mentioned earlier, however, pump tolerances differ and even if both shafts were to be displaced axially the same distance, different amounts of components would be pumped. Moreover, the shafts travel exactly the same distance only if there is no leakage past pistons 18 or 30. As a practical matter, some leakage is bound to occur so even the theoretically equal travel of shafts will not be obtained.

This invention addresses and solves both of these problems. The means for adjusting the novel system to compensate for differences in pumping capacity of differing pumps will be disclosed first.

A trip means in the form of a radially extending trip member 54 is carried by the free end of pump shaft 16 as shown in the upper left hand corner of the Fig., and a similar trip member 56 is carried by the free end of pump shaft 28. These trip members engage limit switch members 58, 60 that are cooperatively positioned upwardly of cylinder end caps 12 and 24, respectively, when pistons 18 and 30 reach their respective top dead center (TDC) and bottom dead center (BDC) positions.

More particularly, limit switch means 58 includes upper limit switch 62 and lower limit switch 64. Similarly, limit switch means 60 includes upper limit switch 66 and lower limit switch 68. It should be apparent that trip members 54 and 56 of cylinders A and B will abuttingly engage upper limit switches 62 and 66, respectively, when pistons 18 and 30 achieve their respective TDC positions. It should be equally apparent that said trip members will engage lower limit switches 64 and 68 when said pistons attain their respective BDC positions.

Conductor 63 provides electrical communication between upper limit switch 62 of cylinder A and computer 48, and conductor 65 provides electrical communication between lower limit switch 64 of cylinder A and computer 48. Conductors 67 and 69 place computer 48 in electrical communication with upper limit switch 66 and lower limit switch 68 of cylinder B, respectively.

Importantly, the respective positions of switches 62, 64, 66 and 68 are adjustable. It should be clear, then, that by adjusting the vertical positions of said switches, the length of the stroke of their associated pump shafts can be adjusted to compensate for differing pump capacities.

The novel structure also includes valve 70 in bypass line 71 that interconnects lines 34 and 50 and valve 72 in bypass line 73 that interconnects lines 50 and 52. Valve 70 is under the control of solenoid 74 and valve 72 is under the control of solenoid 76. Line 75 electrically connects solenoid 73 to computer 48 and line 77 electrically connects solenoid 76 to said computer.

The novel system operates as follows: Process computer 48 signals solenoid 43, which controls four-way valve 42, to initially provide fluid communication between hydraulic oil source 36 and lower chamber 19 of cylinder A through conduit 34. This introduction of fluid into chamber 19 drives piston 18 and pump shaft 16 upwardly as indicated by directional arrow 80; the upwardly directed stroke of said pump shaft 18 effects pumping of a component to the mixer block, not shown, of a conventional molding machine, now shown. Simultaneously, oil in upper chamber 17 of cylinder A is driven out of that chamber by piston 18, and said oil is constrained to exit said chamber through interconnecting line 50 and to enter lower chamber 31 of cylinder B. Note that if no oil leaks around seal 22 of piston 18, the volume of oil driven from upper chamber 17 of cylinder A is equal to the volume of oil that enters lower chamber 31 of cylinder B. This oil drives piston 30 of cylinder B upwardly as indicated by directional arrow 82. If the respective cross sectional areas of cylinders A and B are equal, then the displacement of piston 30 will equal the displacement of piston 18. Thus, pump shaft 28, which is keyed to piston 30, theoretically pumps the same amount of component pumped by pump shaft 16, subject to the above-mentioned differences in pumps as compensated for by the adjustable limit switch arrangement already described. This equal volume pumping is desirable in those applications where a 1:1 ratio of different components is to be delivered to the mixer block.

Where it is desired to deliver twice as much of the component pumped by shaft 16 as is pumped by shaft 28, the cross section of cylinder A is halved, or, conversely, where it is desired to deliver twice as much of the component pumped by shaft 28, the cross section of cylinder B would be halved. It should be clear that any ratio of components may be pumped, then, by simply changing the ratio of the diameters of the drive cylinders A and B. Just as importantly, it should be understood that additional cylinders C, D, and so on (not shown) could be provided, there being as many cylinders as there are components to be mixed, and any proportion thereof may be delivered to the unillustrated conventional mixer block by simply selecting the ratio of the diameter of the respective drive cylinders.

To better understand the operation of novel system 10, reference will first be made to the situation where only two cylinders are used, and where both cylinders are of the same diameter. When piston 18 reaches its top dead center (TDC) position, trip member 54 engages upper limit switch 62; this sends a pulse over conductor 63 to process computer 48. If there are no leaks in the system, trip member 56 will simultaneously engage upper limit switch 66 of cylinder B and computer 48 will thus simultaneously receive signals indicating that pistons 18 and 30 have reached their respective TDC positions. If this happens, the computer 48 then sends a signal to solenoid 43 which causes that solenoid to open valve 42 so that upper chamber 29 of cylinder B is now in fluid communication with source 36 through supply conduit 40 and branch supply conduit 52. Oil is then pumped through said conduits into said upper chamber 29 and piston 30 begins its downward travel as indicated by directional arrow 84. Oil in lower chamber 31 of cylinder B thus flows through interconnecting conduit 50 and enters upper chamber 17 of cylinder A and piston 18 travels downwardly as indicated by directional arrow 86. Again assuming no leaks around the seals 22 and 32 of pistons 18 and 30, respectively, trip members 54 and 56 will simultaneously trip or engage their respective lower limit switches 64 and 68. Such switches, when activated, send a pulse to computer 48 and said computer reconfigures valve 42 through solenoid 43 to repeat the above-described cycle of operation.

Now assume that oil leaks around the seals of pistons 18 or 30, or leaks completely out of the machine at some other location. Any such leakage will cause the respective trip members 54 and 56 to engage their associated upper or lower limit switches at different times.

For example, suppose oil is being pumped from source 36 to upper chamber 29 of cylinder B. With no leakage, the oil in lower chamber 31 will flow via conduit 50 to upper chamber 17 of cylinder A, and trip members 54 and 56 will simultaneously arrive at their respective lower limit switches 64 and 68. If oil leaks around seal 32 of piston 30, some of the oil flowing into upper chamber 29 will leak into lower chamber 31 and trip member 54 of cylinder A will engage its lower limit switch 64 before trip member 56 of cylinder B engages its lower limit switch 68. When this happens, computer 48 opens solenoid 74-operated bypass valve 70 in bypass line 71, thereby allowing the excess oil in upper chamber 17 of cylinder A to return to source 36 through bypass conduit 71, branch supply conduit 34 and return conduit 38. This allows piston 30 and hence shaft 28 to continue travelling downwardly until trip member 56 engages lower limit switch 68.

As an additional example, suppose oil leaks into upper chamber 17 of cylinder A when piston 18 is traveling in the direction of arrow 80. Trip member 56 of cylinder B will engage upper limit switch 66 before trip member 54 of cylinder A will have engaged its upper limit switch 62 because the oil leaking from lower chamber 19 of cylinder A will be added to the fluid delivered to lower chamber 31 of cylinder B through interconnecting conduit 50.

Process computer 48 is programed to expect a signal from upper limit switch 62 of cylinder A at the same time a signal is received from upper limit switch 66 of cylinder B. When the cylinder B limit switch signal is received in the absence of a signal from limit switch 62, the computer reconfigures the system by causing solenoid 76 to open bypass valve 72 in bypass conduit 73 of cylinder B so that the excess oil in upper chamber 17 of cylinder A is allowed to return to source 36 through interconnecting conduit 50, bypass conduit 73, branch supply conduit 52 and return conduit 38.

In still another situation, suppose valve 42 is configured so that oil flows from source 36 into the upper chamber 29 of cylinder B when the seal 22 around piston 18 of cylinder A is leaking. Trip member 56 of cylinder B will in that situation trip lower limit switch 68 before trip member 54 of cylinder A engages its lower limit switch 64. Computer 48 detects that piston 30 has achieved BDC and that piston 18 has not. Accordingly, said computer causes bypass valve 72 to open bypass conduit 73 and thus allow fluid to flow from upper chamber 29 of cylinder B into upper chamber 17 of cylinder A via interconnecting conduit 50 and bypass conduit 73, until trip member 54 trips lower limit switch 64.

When said bypass valve 72 is open as aforesaid, oil will also flow into the lower chamber 31 of cylinder B.

As mentioned earlier, one pump shaft might pump a different amount of component per stroke than the other pump shaft, even if the piston seals are not leaking. Moreover, there may be miscellaneous other leaks throughout the system which cause one pump to pump more component per stroke than the other. In either situation, the novel arrangement of parts insures that the proper ratio of components will always be pumped; this is accomplished through manipulation of the upper and lower limit switches.

As an example, assume that the pump associated with cylinder A, over a complete two stroke cycle, pumps three percent more component than the pump associated with cylinder B. This condition is compensated for by placing upper limit switch 62 three percent closer to lower limit switch 64, i.e., where the spacing between upper limit switch 66 and lower limit switch 68 is a certain distance, the distance between upper limit switch 62 and lower limit switch 64 is set at ninety-seven percent of that distance.

It was mentioned earlier that a change in component ratio can be made by predetermining the respective diameters of cylinders A and B. The upper and lower limit switches may also be used to affect such changes in ratios. Thus, where a 2:1 ratio of component A to component B is desired, the distance between upper limit switch 62 and lower limit switch 64 is set at fifty percent of the distance between upper limit switch 66 and lower limit switch 68. In this manner, pump shaft 16 will reciprocate twice for every reciprocation of pump shaft 28. Any other ratio is achieved by the same means. This change in ratio is accomplished easily, thereby facilitating the preparation of reactive systems such as epoxies, where the ratio of base to hardener affects a number of physical properties of the cured material and also affects the rate of cure and the shrinkage factor during cure. Moreover, it is advantageous for these types of curing systems to have the ability to vary the ratio of base to hardener, or the ratio of other components to one another to optimize the required characteristics. It was heretofore unknown, anywhere in the world, that component ratios could be changed by simply repositioning limit switches such as disclosed herein.

The examples of system operation provided herein are not exhaustive of the system's capabilities. The physical structure disclosed herein can be reconfigured in numerous different valve settings, for example, to solve metering problems not expressly recited herein. The number of problems that can be solved and the specific system configurations required to solve said problems are limited only by the imagination of the programmer of the process computer.

This invention is clearly new and useful. Moreover, it was not obvious to those of ordinary skill in this art at the time it was made, in view of the prior art considered as a whole.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An apparatus for pumping multiple components in a predetermined ratio, comprising:

first and second drive cylinders;

each of said drive cylinders slidably receiving a reciprocably mounted piston therein and each of said pistons being secured to a pump shaft that is received within its associated drive cylinder and which axially reciprocates with respect thereto, said drive cylinders being stationary;

an interconnecting conduit providing fluid communication between said drive cylinders, on opposite sides of said pistons;

a first and second branch supply line providing fluid communication between a source of hydraulic fluid and said first and second drive cylinders, respectively;

a first bypass line providing fluid communication between said interconnecting conduit and said first branch supply line;

a second bypass line providing fluid communication between said interconnecting conduit and said second branch supply line;

a first valving means disposed in said first bypass line;

a second valving means disposed in said second bypass line;

a third valving means disposed between said source of hydraulic fluid and said first and second branch supply lines; and a process computer for controlling flow of hydraulic fluid through the apparatus by selectively opening and closing said first, second and third valves and by controlling a pump that pumps hydraulic fluid through the apparatus from said source of hydraulic fluid.

2. The apparatus of claim 1, further comprising:

a trip member carried by each of said pump shafts;

an upper and lower limit switch associated with said first drive cylinder and an upper and lower limit switch associated with said second drive cylinder;

each of said trip members being adapted to engage an associated limit switch member as its associated pump shaft axially reciprocates between a top dead center and a bottom dead center position;

all of said limit switches being conductively coupled to said process computer so that information supplied to said process computer by the engagement of a limit switch and a trip member is used to adjust operating parameters of the apparatus.

3. The apparatus of claim 2, wherein all of said limit switches are adjustably positioned with respect to one another.

4. A self-adjusting metering machine, comprising:

a first pump having an axially reciprocable first pump shaft;

a second pump having an axially reciprocable second pump shaft;

a first drive cylinder having apertured end plates that axially receive said first pump shaft;

a second drive cylinder having apertured end plates that axially receive said second pump shaft;

a first piston carried by said first pump shaft and being reciprocable within said first drive cylinder;

said first piston dividing said first drive cylinder into an upper chamber and a lower chamber;

a second piston carried by said second pump shaft and being reciprocable within said second drive cylinder;

said second piston dividing said second drive cylinder into an upper chamber and a lower chamber;

an interconnecting conduit disposed in fluid communicating relation between a first preselected chamber of said first drive cylinder and a first preselected chamber of said second drive cylinder;

a first branch supply conduit disposed in fluid communicating relation between a second preselected chamber of said first drive cylinder and a source of hydraulic fluid;

a first bypass conduit disposed in fluid communicating relation between said interconnecting conduit and said first branch supply conduit;

a second branch supply conduit disposed in fluid communicating relation between a second preselected chamber of said second drive cylinder and said source of hydraulic fluid;

a second bypass conduit disposed in fluid communicating relation between said interconnecting conduit and said second branch supply conduit;

a first trip member carried by said first pump shaft;

a second trip member carried by said second pump shaft;

a first pair of vertically spaced limit switch means including a first upper limit switch member and a first lower limit switch member being disposed in a predetermined relation to said first trip member so that when said first piston member attains its top dead center position within said first drive cylinder, then said first trip member engages said upper limit switch member and so that when said first piston member attains its bottom dead center position within said first drive cylinder, then said first trip member engages said lower limit switch member;

a second pair of vertically spaced limit switch means including a first upper limit switch member and a first lower limit switch member being disposed in a predetermined relation to said second trip member so that when said second piston member attains its top dead center position within said second drive cylinder, then said first trip member engages said upper limit switch member and so that when said second piston member attains its bottom dead center position within said second drive cylinder, then said second trip member engages said lower limit switch member;

a process computer;

said upper and lower limit switch members of said first and second pair of limit switch means being conductively coupled to said process computer; and said process computer adapted to control flow of hydraulic fluid into and out of said first and second drive cylinders as required to insure that said first and second pump shafts are displaced in accordance with a predetermined ratio with respect to one another.

5. The machine of claim 4, wherein said first and second pair of limit switch means are adjustably mounted so that the amount of vertical spacing therebetween is adjustable.

6. The machine of claim 5, further comprising a first bypass valve, under the control of said computer, disposed in valving relation to said first bypass conduit, and a second bypass valve, under the control of said computer, disposed in valving relation to said second bypass conduit.

7. The machine of claim 6, further comprising a supply conduit disposed in fluid communicating relation between a hydraulic pump and said first and second branch supply conduits.

8. The machine of claim 7, further comprising a return conduit disposed in fluid communicating relation between said source of hydraulic fluid at a first end thereof and said supply conduit and said first and second branch supply conduits at a second end thereof.

9. The machine of claim 8, further comprising a solenoid-activated control valve member disposed at a juncture of said supply conduit, said first and second branch supply conduits, and said return conduit.

10. The machine of claim 9, wherein said control valve is a four way valve and wherein said control valve is under the control of said process computer.

11. An apparatus for pumping multiple components in a predetermined ratio, comprising:

a plurality of stationary drive cylinders, there being as many drive cylinders as there are components to be pumped and each of said drive cylinders being filled with hydraulic fluid;

a plurality of piston members, there being as many piston members as there are drive cylinders, and each of said piston members being axially reciprocable within their associated drive cylinders between a top dead center and a bottom dead center position;

a plurality of pump shafts, equal in number to the number of drive cylinders, each of said pump shafts being axially received by an associated drive cylinder;

each of said plurality of piston members being secured to an associated pump shaft so that reciprocation of each of said plurality of piston members within an associated drive cylinder effects simultaneous and corresponding reciprocation of said pump shafts;

a plurality of branch supply conduits disposed in fluid communicating relation between a source of hydraulic fluid and each of said drive cylinders;

an interconnecting conduit disposed in fluid communication between each of said drive cylinders;

a bypass valve disposed in fluid communicating relation between each of said interconnecting conduits and each of said branch supply conduits;

a control valve having plural configurations being disposed in interconnecting relation to said source of hydraulic fluid and each of said branch supply conduits and to a return conduit; and sensing means for sensing the respective axial positions of each of said pump shafts and for opening and closing said bypass valves and said control valve as needed to cause each pump shaft to travel axially by a predetermined amount;

whereby failure of any pump shaft to travel a predetermined axial distance is corrected by delivering adequate hydraulic fluid to the drive cylinder associated with such insufficiently displaced pump shaft.

12. The apparatus of claim 11, wherein said sensing means includes a pair of vertically spaced limit switch members associated with each of said pump shafts, and further includes a trip member associated with each of said pump shafts for activating said limit switch members.

13. The apparatus of claim 12, wherein the vertical spacing between the limit switch members is adjustable so that the respective pump shafts may be made to reciprocate at predetermined ratios with respect to one another.

* * * * *